United States Patent [19]

Bowman

[11] 4,367,976

[45] Jan. 11, 1983

[54] EXPANSION JOINT SEALING STRIP ASSEMBLY FOR ROADWAYS, BRIDGES AND THE LIKE

[75] Inventor: William E. Bowman, Englewood, Colo.

[73] Assignee: Bowman Construction Supply, Inc., Denver, Colo.

[21] Appl. No.: 164,013

[22] Filed: Jun. 30, 1980

[51] Int. Cl.[3] ..... E01C 11/04

[52] U.S. Cl. ..... 404/68; 404/64

[58] Field of Search ..... 404/65, 64, 68, 47, 404/69; 14/16.5; 52/396, 403; 49/475

[56] References Cited

U.S. PATENT DOCUMENTS

| | | | |
|---|---|---|---|
| 3,994,609 | 11/1976 | Puccio | 52/396 |
| 4,067,660 | 1/1978 | Puccio | 52/396 |
| 4,179,226 | 12/1979 | Puccio | 404/64 |
| 4,221,502 | 9/1980 | Tanikawa | 404/68 |

FOREIGN PATENT DOCUMENTS

| | | | |
|---|---|---|---|
| 586790 | 4/1977 | Switzerland | 404/64 |

*Primary Examiner*—Nile C. Byers, Jr.
*Assistant Examiner*—Roberto L. Calderon
*Attorney, Agent, or Firm*—Mason, Fenwick & Lawrence

[57] ABSTRACT

An expansion joint seal assembly for sealing a roadway gap, which includes a pair of spaced apart elongated anchoring channel extrusion members to be secured in structural slab portions oppositely bounding the gap, and an elongated resilient sealing strip member for sealing the gap between the anchoring channel members. The anchoring channel members have an anchoring cavity opening toward the gap shaped to define a constricted entrance throat portion opening to the gap and communicating with a transversely enlarged, inner retaining chamber portion, and the strip member has a diaphragm web portion providing distortable folds and anchoring bead formations each forming substantially a hollow triangle in cross-section providing a back wall portion and a pair of forwardly converging walls which form an apex located below a horizontal reference plane extending through the vertical midpoints of back wall portion and provide a shallow concave trough immediately subjacent each apex.

22 Claims, 8 Drawing Figures

Fig-2-A

Fig-3
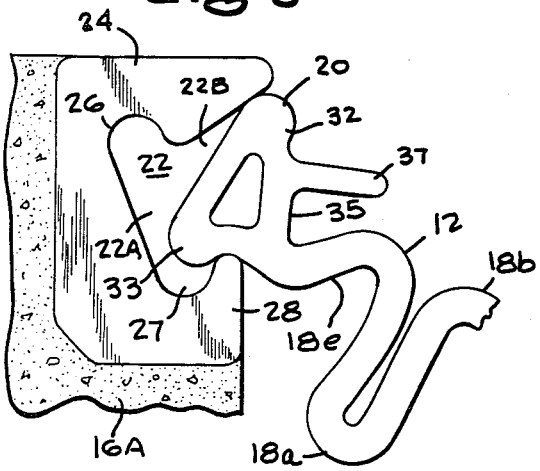
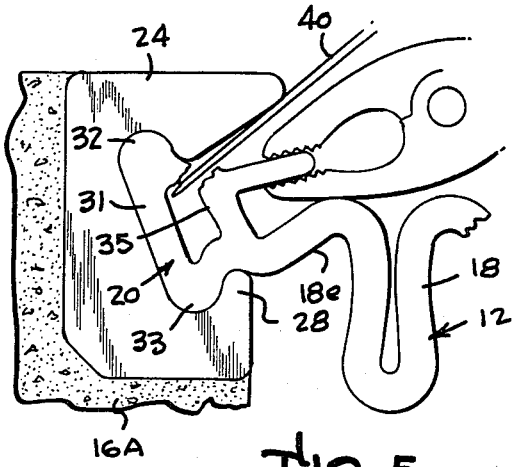
Fig-5
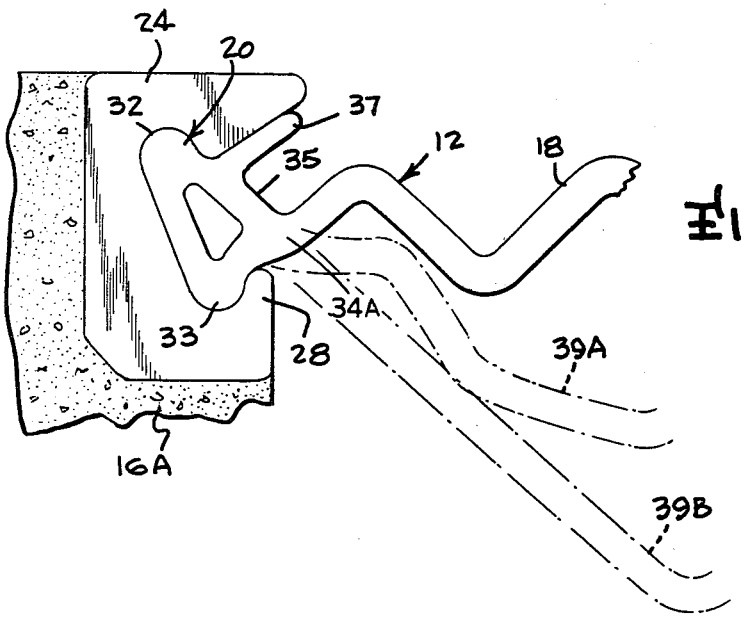
Fig-4
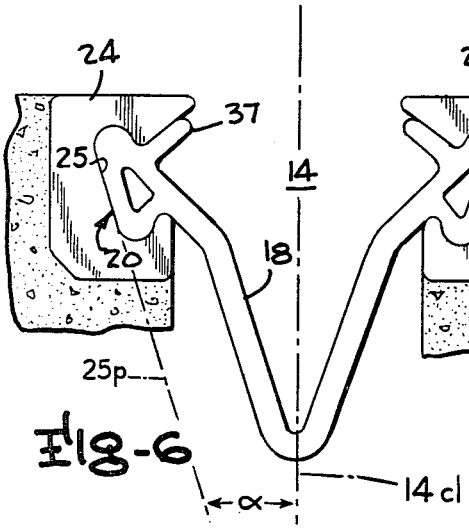
Fig-6
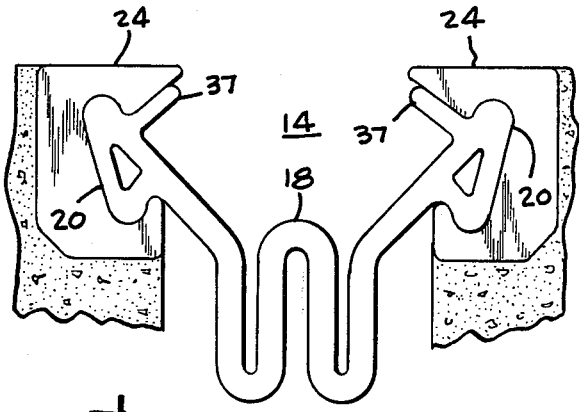
Fig-7

EXPANSION JOINT SEALING STRIP ASSEMBLY FOR ROADWAYS, BRIDGES AND THE LIKE

BACKGROUND OF THE INVENTION

The present invention relates in general to expansion joint seal assemblies of the type used for sealing an expansion joint space or gap in a roadway, bridge or the like against the intrusion of dirt, water, and other debris and contaminants as for example might be encountered by expansion joints in roadway and bridge installations. More specifically, the present invention relates to an elastomeric expansion seal assembly formed of a shaped elastomeric diaphragm seal member and a pair of elongated extruded metal anchor channels installed on opposite sides of the gap or space to be protected and embedded in concrete slabs to achieve anchoring of the diaphragm seal member between the anchor channels.

A persistent problem which has been encountered in connection with expansion joint sealing strip assemblies of the type to which the present invention is related is that the retaining or mounting or anchoring bead portion of the flexible or elastomeric seal member becomes dislodged from one of the edge members forming the anchor formations for the ends of the sealing diaphragm over part or all of the longitudinal extent of the joint, so that the seal no longer remains watertight and consequently ceases to perform a primary function for which it was provided. Numerous proposals have been made for variations in design of the edge bead formations or mounting portions along opposite edges of the seal strip of expansion joint seal assemblies seeking to minimize the possibility of failure of the anchoring or edge retaining portions by dislodging of the seal strip member from the edge retaining formation of the assembly. In the case of expansion joint sealing strip assemblies having mounting beads along the longitudinal edges thereof to be mounted in correspondingly shaped cavities of the edge retaining or anchoring components, a number of specific problems have been recognized. In many of the prior art expansion joint sealing strip assemblies, it has been very difficult to shape the metal edge retaining or anchoring members with a cavity for receiving the mounting beads along the edge of the sealing strip with a cavity of properly precise cross-section which includes the desired degree of high-tolerance along the length of the edge retaining member. Frequently, the manufacture of such edge retaining metal devices as a metal extrusion with a shaped cavity therein requires that the cavity be of precisely uniform cross-section throughout the entire length of about a 16 foot or more longitudinal length of the extrusion, as may be required for a road or bridge joint, and in such lengths, it has been found that the extruding of the edge retaining member fails to maintain appropriate uniformity in the cross-sectional dimensions of the cavity along the entire longitudinal span required. However, it has been possible to maintain the desired high-tolerance with respect to the configuration and cross-sectional dimensions of the retaining bead or edge portion of the expansion joint sealing strip. The discrepancy in the extent to which high-tolerances can be maintained in the shape of the cavity and the shape of the bead formation results, of course, in frequent instances of the bead becoming more easily dislodged from the cavity of the retaining member.

Additionally, problems have been encountered in developing optimum designs for the shape of the retaining beads along the edges of the sealing strip to facilitate insertion of the bead into the cavity of the bead retaining anchor or edge members. While efforts have been made to facilitate the introduction of beads into the retaining cavities by making the beads hollow, permitting them to be more readily compressed and deformed to be received in the retaining cavity, this also enables the hollow edge bead formations to be more easily deformed and pulled out of the retaining cavities of the retaining channel or anchor members under various conditions, particularly as hard or solid contaminants work into the cavity and as water intrudes into the cavity and freezes.

Additionally, as cross-sectional design configurations of the edge retaining beads have been modified to resist intrusion of solid contaminants and water intrusion into the anchor member cavity, it has become more and more difficult to manually extract the retaining bead portions of the sealing strips from the retaining cavities when it is desired to replace or service the sealing strips for the expansion joints. While efforts have been designed to facilitate the provision of snap-in-action insertion of the sealing strip edge formations into the retaining cavities, it has been discovered that the modifications of the configuration of the snap-in retaining beads to enable them to more easily snapped-in also carries the disadvantage that they can be more easily pushed out. Also, while the configuration of the sealing material, usually made of an elastomer, such as a high-grade neoprene or the like, is such as to allow the retaining bead edge portions of the elastomer sealing strip to move apart and together at skew angles, many shapes designed to permit the strip to open and close on skew angles are such that tearing and undue force on the sealing strip is encountered.

Accordingly, an object of the present invention is the provision of a novel elastomeric expansion joint sealing strip assembly having mounting or retaining bead formations along the longitudinal edges of the sealing strip insertable into a shaped cavity of each of a pair of opposite channel anchor members, wherein the retaining beads and the cavity are of novel coactive configuration correlated with corrugations or folds of the sealing strip to facilitate insertion and extraction of the retaining beads from the cavities of the anchor channel members.

Another object of the present invention is the provision of a novel elastomeric expansion joint sealing strip assembly as described in the immediately preceding paragraph, provided with initially hollow retaining bead formations along the longitudinal edges of the sealing strip portion which may be filled with semi-rigid material to facilitate locking of the retaining bead formations in the cavities of the anchor channel members, but which are also provided with tabs which coact with portions of the cavities and retaining bead formations of novel shape facilitating extraction of the retaining bead formations from the cavities when it is desired to replace or service the sealing strips.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 2A is a fragmentary view to enlarged scale showing the left hand channel and anchoring bead portion;

FIG. 3 is a view similar to the left hand half of FIG. 2, showing the elastomeric diaphragm sealing strip in process of being inserted into the anchoring cavity of the left hand anchoring channel;

FIG. 4 is a view similar to FIG. 3, but showing in broken lines the web portion of the sealing strip in various stages of extension;

FIG. 5 is a view similar to FIGS. 3 and 4, showing the sealing strip in process of being removed from the anchoring cavity of one of the anchoring channels; and FIGS. 6 and 7 are end view of sealing strips of other shapes that may be used.

DETAILED DESCRIPTION OF A PREFERRED EMBODIMENT

Figure 1:
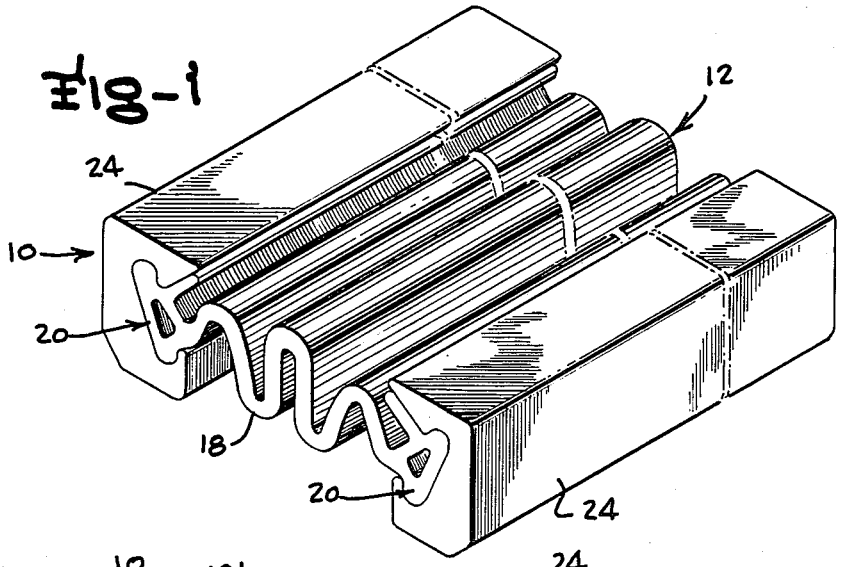
FIG. 1 is a perspective view of an expansion joint sealing strip assembly for roadways and the like embodying the present invention.

Referring to the drawings, wherein like reference characters designate corresponding parts throughout the several figures, the expansion joint sealing strip assembly for roadways, bridges and the like of the present invention is indicated generally by the reference character 10 and comprises as the principal elements thereof an elastomeric diapharagm sealing strip 12 of rubber or similar flexibly deformable elastomeric composition, which is in the form of an elongated sealing strip of uniform cross-section throughout having a length adequate to span a gap or joint, as indicated at 14, in a roadway, bridge or similar construction between a pair of structural slab sections 16A,16B. The elastomeric diaphragm sealing strip 12 generally comprises as its basic parts an intermediate web or diaphragm portion 18 formed of one or a plurality of bends, folds, or recurved convolutions extending between two marginal enlarged anchoring bead formations 20 forming the opposite longitudinal edge portions of the sealing strip 12. These enlarged anchoring bead formations 20 are adapted to be received and held in the anchoring cavities 22 of a pair of anchoring channels 24 of like cross-sectional configuration, embedded or securely affixed to the structural slab sections 16A,16B located at the upper portions of the confronting faces of the slab section 16A,16B bounding the joint or gap 14 with the anchoring channels 24 opening toward each other.

Each of the anchoring channels 24 are preferably formed as extruded metal anchoring channels, formed for example of steel, having what may be described as a distorted C-shaped cross-section, with the anchoring channels 24 in the illustrated embodiment having planiform parallel horizontal upper and lower faces 24A and 24B and planiform rear face 24C joined by rounded corners. The bead receiving anchoring cavity 22 in each anchoring channel 24 has a specially shaped cross-section bounded by a flat planiform rear or base wall 25 lying in an inclined plane declining generally from the upper rear corner of the upper face 24A downwardly toward but somewhat rearwardly of the front corner of the lower face 24B joining at its upper and lower ends a pair of opposed confronting concave recessed troughs forming upper and lower concave retaining wings 26,27 located at the opposite rear or root corners of the cavity 22 laterally bounding the enlarged retaining chamber 22A. The cavity 22 also includes a specially shaped entrance throat portion 22B which is of constricted transverse dimension relative to the top to bottom dimension of the retaining chamber 22A and is defined by a rounded upwardly convex toe formation 28 forming a rounded fulcrum in the lower region of the front face 24D of the channel 24 located at a level above the lowermost portion of the lower retaining recessed trough 27, while the upper portion of the entrance throat 22B is defined by a rearwardly or inwardly declining ramp surface 29 having rounded portions **29*a*,29*b* where it merges into the upperfront corner portion of the channel 24 and into the forwardmost portion of the upper retainer recessed trough 26**.

Figure 2:
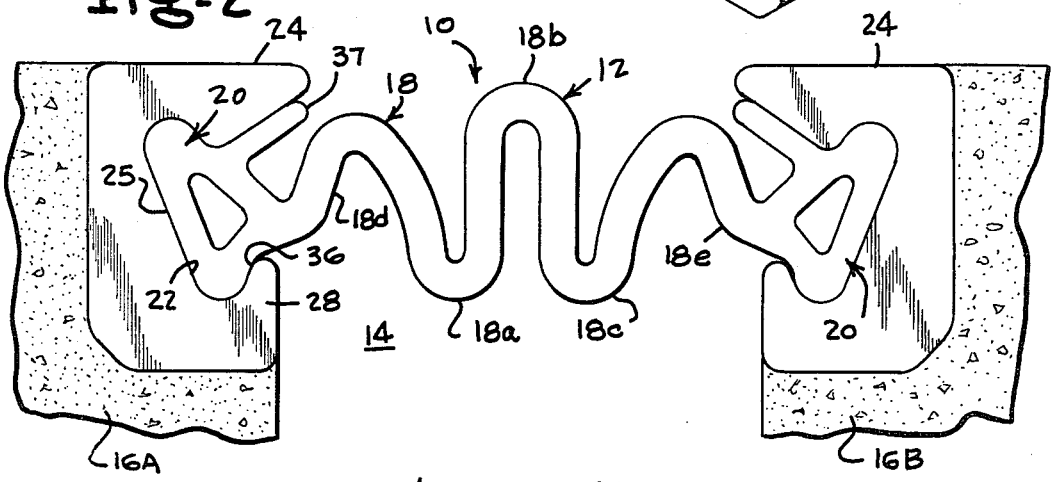
FIG. 2 is am end view of the expansion joint sealing strip assembly including the elastomeric diaphragm sealing strip of one example and the pair of anchoring channels therefor showing their cross-sectional configuration.
Figure 2:
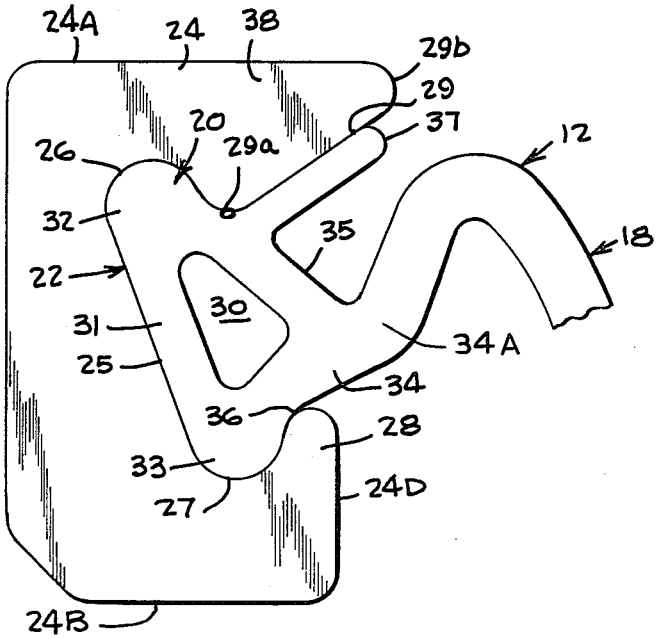

While the enlarged anchoring bead formations 20 of the elastomeric sealing strip 12 are of the same cross-sectional configuration in each variation thereof, the intermediate web or diaphragm portion 18 thereof may be in several forms, one of which is illustrated in FIGS. 1 to 5 wherein the wet or diaphragm portion 18 executes three sinuous folds or recurves, indicated at **18*a*,18*b* and 18*c* which then join the anchoring bead formations 20 by upwardly and outwardly arching portions 18*d* and 18*e*. It will be appreciated, however, that the web or diaphragm 18 may simply employ a single fold, wherein the web or diaphragm portion 18 is generally in the shape of a downwardly pointing V in cross-section, or a greater number of sinuous or recurving folds than the three illustrated in FIGS. 1 through 5 may be employed, such as the shapes shown in FIGS. 6 and 7**.

In either variation, the enlarged anchoring bead formation 20 is of the special cross-sectional shape illustrated in the Figures, having a hollow center 30, encompassed by a straight rear wall 31 whose exterior surface conforms to and is designed to butt flat against the rear or base wall 25 of the cavity 22, bounded at each end by upper and lower convex salient bulges or promontories 32,33, a short lower wall portion 34 forming, in effect, the base of a generally triangular hollow center 30, and a front membrane wall 35 which extends along a downwardly divering plane relative to the plane of the rear wall 31. The lower face of the anchoring bead formation 20 of the sealing strip 12 includes a shallow downwardly concave trough portion 36 forming a recess into which the toe formation 28 normally seats, and the web or diaphragm portion 18 joins the bead formation 20 substantially at the apex formed where the lower wall portion 34 and front membrane wall 35 meet, indicated at 34A, and extends initially toward the vertical center plane of the gap or joint along an upwardly arching, slightly convex curved path. The anchoring bead formation 20 also includes an upwardly inclining, tab-forming rib 37 extending from the upper portion of the front membrane wall 35 approximately at the uppermost region of the substantially triangular hollow center 30 of the bead formation 20, which normally lies flat against the upwardly and forwardly inclining ramp surface 29 bounding the upper generally triangular nose formation 38 defined by the ramp surface 29 and rounded surface portions **29*a*,29*b*, and the adjoining portions of the upper flat exterior surface 24A and the adjacent surface of the uppermost concave recessed trough 26**.

When inserting the enlarged anchoring bead formation 20 of the sealing strip 12 into the cavity 22 of each of the anchoring channels 24, the bead formation is first introduced in the position illustrated in FIG. 3, wherein the lower salient bulge or promontory 33 enters the lower portion of the entrance throat 22B of the cavity 22 and protrudes inwardly into the enlarged retaining chamber 22A over the rounded upwardly extending toe formation 28 of the channel 24. The elastomeric or rubber strip convolutions, for example convolutions 18*a* and 18*b* will assume the distorted position illustrated in FIG. 3, exerting pressure toward the anchoring channel 24 and thus holding the lower salient bulge 32 over the lower toe formation 28. The upper portion of the elastomeric sealing strip forming the upper salient bulge 32 can then be introduced into the cavity 22 by pressing against the bead formation 20 in the trough-shaped zone defined between the upper salient bulge 32 and the tab-forming rib 37 and compressing the hollow bead formation 20 while rotating the lower bulge formation 33 over the rounded toe 28 at the entrance throat to the cavity as shown in FIG. 3. The anchoring bead formation 20 of the elastomeric sealing strip 12 then fully enters the cavity 22 to assume the position illustrated in FIGS. 1 and 2.

Once the elastomeric sealing strip 12 is inserted within the anchoring channels 24, it is very difficult to remove the strip due to the location of the web or diaphragm portion 18 on the inserted bead formation 20 disposed in the shaped cavity 22, thus providing great holding power to resist dislodging of the bead formations from the anchoring channel cavities if stones, dirt and debris get into the joint or gap 14 between the two channels 24 and the wheel or tire of a vehicle exerts pressure on this debris and forces it downwardly into the joint against the web or diaphragm portion 18. It will be observed from FIG. 4, illustrating various possible distorted positions of the diaphragm or web portion 18, that the diaphragm convolutions flatten and allow the channels 24 to move apart easily without dislodging the bead formations from the anchoring channel cavities. When and if incompressibles get on the elastomeric diaphragm or web portion 18, and the diaphragm portion takes a shape such as shown in dotted lines at 39A or 39B, for example, the lower salient bulge 33 tends to lock the sealing strip over the rounded toe 28 forming the lower part of the entrance throat to the cavity 22, so that even when the web or diaphragm portion 18 is taken to its fullest compressed form, the lower salient bulge 33 is held in place by the rounded upwardly extending toe formation 28 as illustrated.

The slope of the inclined plane in which the cavity rear wall 25 and the confronting surface of the rear wall 31 of the anchoring bead formation 20 lies, forms a small acute angle $\alpha$ indicated for convenience in FIG. 6 between phantom lines 25*p* and 14*cl.*, respectively, indicating the plane of channel back surface 25 and the vertical center line of the gap 14. Because of this, when the intermediate web or diaphragm portion 18 is depressed, as to the fully extended or less fully extended positions illustrated in broken lines at 39A,30B, the line of the front membrane wall 35 and the adjoining portions of the intermediate web or diaphragm portion 18 is approximately parallel to that plane, and the fact that the apex 34A at the convergent intersection of the wall portions 34 and 35 of each anchoring bead formation 20 lies in the lower half of the bead formation below the horizontal midplane through the center axis of each bead formation, thus placing the trough formation 36 for the toe formation 28 immediately subjacent the apex 34A, the sealing strip locks over the toe formation 28 of the anchoring channel 24. When the anchoring channels 24 are closer together, or at less than their full extension, the line defined by the front membrane wall 35 and the adjoining portion of the intermediate diaphragm or web portion 28 is still in the position that the extension of the diaphragm portion downwardly will cause the rounded toe formation 28 to lock the strip in place as the slope of the rear wall 25 is still approximately parallel to these portions of the sealing strip.

The sealing strip can be removed from the anchoring channels 24 by grasping the tab-forming rib 37, with pliers or similar pulling tool, and pulling and cutting through the wall portion of the anchoring bead formation 20 between the upper salient bulge portion 32 and tab-forming rib 37, with a knife or similar tool as indicated at 40 in FIG. 5.

If desired, the hollow center 30 of the anchoring bead formation 20 of the strip can be filled with a semirigid material, such as epoxy compounds or similar compositions, thus making the entire area of the generally triangular anchoring bead formation 20 semisolid and thus locking it into the associated anchoring channels 24. Still, the sealing strip may be removed from the associated anchoring channels by pulling on the tab-forming rib 37 and cutting along the plane of the knife 40 shown in FIG. 5, as this produces a rotating motion on the components of the anchoring bead formation and with the upward pull the tab formation 37 and front membrane wall 35 and lower salient bulge 33 assume an approximate straight line and rotate about the toe formation 28 enabling removal of the strip from the anchoring channel cavity.

I claim:

1. An expansion joint seal assembly for sealing a roadway gap and the like, comprising a pair of spaced apart elongated anchoring channel extrusion members to be secured in structural slab portions oppositely bounding the gap, each of the anchoring channel members including a generally rectangular cross-section channel-shaped body having an anchoring cavity extending the length thereof opening toward the gap shaped to define a constricted entrance throat portion opening to the gap through a front face of the channel member and communicating with a transversely enlarged, rearwardly spaced inner retaining chamber portion, the constricted throat portion being bounded below by a rounded toe formation, the retaining chamber portion having a generally oval vertically elongated cross-sectional configuration whose major axis lies in an inclined plane declining in downwardly convergent relation forming a small acute angle with a vertical center plane of the gap and providing a flat back wall paralleling said inclined plane between opposed concave recessed troughs forming the upper and lower bounding surfaces of the retaining chamber, an elongated resilient sealing strip member for sealing the gap between said anchoring channel members including an intermediate diaphragm web portion bounded along each longitudinal edge by enlarged anchoring bead formations of like cross-section, the web portion having a folded cross-section configuration providing distortable fold portions for maintaining sealing of the gap while accommodating expansion and contraction of the width thereof, and said anchoring bead formations each forming substantially a hollow triangle in cross-section comprising a generally flat back wall portion forming one side of the triangle and bottom and front wall portions forming the other sides of the triangle and generally converging toward the center of the gap to intersect and form an apex located below a horizontal reference plane extending through the vertical midpoints of said back wall portions, said back wall portion joining upper and lower convex salient promontories whose exterior surfaces conform in cross-section to the surfaces of said recessed troughs and back wall to intimately interfit in said retaining chamber portion and anchor the sealing strip therein, said web portion joining said bead formations at said apexes and forming with said bottom wall portions a shallow concave trough immediately subjacent each said apex receiving said lower rounded toe formation in nested relation therein as a fulcrum about with the bead formation pivots to insert the bead formation into the anchoring cavity.

2. An expansion joint seal assembly as defined in claim 1, wherein said channel member includes a generally triangular cross sectioned nose formation with rounded corners forming the upper boundary surface of said constricted entrance throat portion providing a flat ramp-like surface declining along a ramp plane disposed nearly perpendicular to said inclined plane providing a ramp against which the uppermost of said convex salient promontories moves as the anchoring bead formation is fulcrumed about said rounded toe formation.

3. An expansion joint seal assembly as defined in claim 2, wherein said intermediate diaphragm web portion includes connecting portions extending the length thereof between said fold portions and said anchoring bead formations extending from the apex of the juncture of said bottom and front wall portions of the bead formations along upwardly convex arching membrane portions of substantially the same thickness as said fold portions and said wall portions of the bead formations merging into upwardly diverging portions of the web portion extending from downwardly convex fold portions, said upwardly arching connecting portions extending in upwardly convergent relation to said ramp surface when said anchoring bead formations are fully seated in said anchoring cavities.

4. An expansion joint seal assembly as defined in claim 1, wherein said anchoring channel member includes a rearwardly declining downwardly facing and rearwardly angled inclined ramp surface outwardly adjoining the narrowest portion of the constricted entrance throat forming a progressively converging guide surface relative to said toe portion for the uppermost salient promontory of the anchoring bead formation to compressively guide the interlocking portions of the bead formations defined by said promontories into said retaining chamber portion of the anchoring cavity.

5. An expansion joint seal assembly as defined in claim 4, wherein said intermediate diaphragm web portion includes connecting portions extending the length thereof between said fold portions and said anchoring bead formations extending from the apex of the juncture of said bottom and front wall portions of the bead formations along upwardly convex arching membrane portions of substantially the same thickness as said fold portions and said wall portions of the bead formations merging into upwardly diverging portions of the web portion extending from downwardly convex fold portions, said upwardly arching connecting portions extending in upwardly convergent relation to said ramp surface when said anchoring bead formations are fully seated in said anchoring cavities.

6. An expansion joint seal assembly as defined in claim 1, wherein said anchoring bead formations include a rib-like, generally planiform tab formation extending the length thereof projecting toward the vertical midplane of said web portion in upwardly converging relation along a plane forming a slightly sharper angle with said vertical midplane than the plane of said ramp surface whereby said tab formation is flexibly stressed downwardly somewhat from its normal elastic memory position to lie flat against said ramp surface when the bead formations are seated fully in said anchoring cavities.

7. An expansion joint seal assembly as defined in claim 6, wherein said intermediate diaphragm web portion includes connecting portions extending the length thereof between said fold portions and said anchoring bead formations extending from the apex of the juncture of said bottom and front wall portions of the bead formations along upwardly convex arching membrane portions of substantially the same thickness as said fold portions and said wall portions of the bead formations merging into upwardly diverging portions of the web portion extending from downwardly convex fold portions, said upwardly arching connecting portions extending in upwardly convergent relation to said ramp surface when said anchoring bead formations are fully seated in said anchoring cavities.

8. An expansion joint seal assembly as defined in claim 1, wherein said intermediate diaphragm web portion comprises a plurality of sinuous reverse curved fold formations curved about parallel horizontal axes of curvature defining an accordion fold diaphragm web portion.

9. An expansion joint seal assembly as defined in claim 8, wherein said channel member includes a generally triangular cross-sectioned nose formation with rounded corners forming the upper boundary surface of said constricted entrance throat portion providing a flat ramp-like surface declining along a ramp plane disposed nearly perpendicular to said inclined plane providing a ramp against which the uppermost of said convex salient promontories moves as the anchoring bead formation is fulcrumed about said rounded toe formation.

10. An expansion joint seal assembly as defined in claim 9, wherein said intermediate diaphragm web portion includes connecting portions extending the length thereof between said fold portions and said anchoring bead formations extending from the apex of the juncture of said bottom and front wall portions of the bead formations along upwardly convex arching membrane portions of substantially the same thickness as said fold portions and said wall portions of the bead formations merging into upwardly diverging portions of the web portion extending from downwardly convex fold portions, said upwardly arching connecting portions extending in upwardly convergent relation to said ramp surface when said anchoring bead formations are fully seated in said anchoring cavities.

11. An expansion joint seal assembly as defined in claim 8, wherein said anchoring bead formations include a rib-like, generally planiform tab formation extending the length thereof projecting toward the vertical midplane of said web portion in upwardly converging relation along a plane forming a slightly sharper angle with said vertical midplane than the plane of said ramp surface whereby said tab formation is flexibly stressed downwardly somewhat from its normal elastic memory position to lie flat against said ramp surface when the bead formations are seated fully in said anchoring cavities.

12. An expansion joint seal assembly as defined in claim 11, wherein said intermediate diaphragm web portion includes connecting portions extending the length thereof between said fold portions and said anchoring bead formations extending from the apex of the juncture of said bottom and front wall portions of the bead formations along upwardly convex arching membrane portions of substantially the same thickness as said fold portions and said wall portions of the bead formations merging into upwardly diverging portions of the web portion extending from downwardly convex fold portions, said upwardly arching connecting portions extending in upwardly convergent relation to said rib-like tab formation.

13. An expansion joint seal assembly as defined in claim 8, wherein said anchoring channel member includes a rearwardly declining downwardly facing and rearwardly angled inclined ramp surface outwardly adjoining the narrowest portion of the constricted entrance throat forming a progressively converging guide surface relative to said toe portion for the uppermost salient promontory of the anchoring bead formation to compressively guide the interlocking portions of the bead formations defined by said promontories into said retaining chamber portion of the anchoring cavity.

14. An expansion joint seal assembly as defined in claim 13, wherein said intermediate diaphragm web portion includes connecting portions extending the length thereof between said fold portions and said anchoring bead formations extending from the apex of the juncture of said bottom and front wall portions of the bead formations along upwardly convex arching membrane portions of substantially the same thickness as said fold portions and said wall portions of the bead formations merging into upwardly diverging portions of the web portion extending from downwardly convex fold portions, said upwardly arching connecting portions extending in upwardly convergent relation to said ramp surface when said anchoring bead formations are fully seated in said anchoring cavities.

15. An expansion joint seal assembly as defined in claim 13, wherein said anchoring bead formations include a rib-like, generally planiform tab formation extending the length thereof projecting toward the vertical midplane of said web portion in upwardly converging relation along a plane forming a slightly sharper angle with said vertical midplane than the plane of said ramp surface whereby said tab formation is flexibly stressed downwardly somewhat from its normal elastic memory position to lie flat against said ramp surface when the bead formations are seated fully in said anchoring cavities.

16. An expansion joint seal assembly as defined in claim 15, wherein said intermediate diaphragm web portion includes connecting portions extending the length thereof between said fold portions and said anchoring bead formations extending from the apex of the juncture of said bottom and front wall portions of the bead formations along upwardly convex arching membrane portions of substantially the same thickness as said fold portions and said wall portions of the bead formations merging into upwardly diverging portions of the web portion extending from downwardly convex fold portions, said upwardly arching connecting portions extending in upwardly convergent relation to said rib-like tab formation.

17. An expansion joint seal assembly for sealing a roadway gap and the like, comprising a pair of spaced apart elongated anchoring channel extrusion members to be secured in structural slab portions oppositely bounding the gap, each of the anchoring channel members including a generally rectangular cross-section channel-shaped body having an anchoring cavity extending the length thereof opening toward the gap shaped to define a constricted entrance throat portion opening to the gap through a front face of the channel member and communicating with a transversely enlarged, rearwardly spaced inner retaining chamber portion, the constricted throat portion being bounded below by a rounded toe formation, the retaining chamber portion having a generally oval vertically elongated cross-sectional configuration whose major axis lies in an inclined plane declining in downwardly convergent relation forming a small acute angle with a vertical center plane of the gap and providing a flat back wall paralleling said inclined plane between opposed concave recessed troughs forming the upper and lower bounding surfaces of the retaining chamber, an elongated resilient sealing strip member for sealing the gap between said anchoring channel members including an intermediate diaphragm web portion bounded along each longitudinal edge by enlarged anchoring bead formations of like cross-section, the web portion having a folded cross-sectional configuration providing distortable fold portions for maintaining sealing of the gap while accommodating expansion and contraction of the width thereof, and said anchoring bead formations each forming substantially a hollow triangle in cross-section comprising a generally flat back wall portion forming one side of the triangle and bottom and front wall portions forming the other sides of the triangle and generally converging toward the center of the gap, said back wall portion joining upper and lower convex salient promontories whose exterior surfaces conform in cross-section to the surfaces of said recessed troughs and back wall to intimately interfit in said retaining chamber portion and anchor the sealing strip therein, and said bottom wall portion having a shallow concave trough therein receiving said lower rounded toe formation in nested relation therein as a fulcrum about which the bead formation pivots to insert the bead formation into the anchoring cavity, said anchoring bead formations including a rib-like, generally planiform tab formation extending the length thereof projecting toward the vertical midplane of said web portion in upwardly converging relation along a plane forming a slightly sharper angle with said vertical midplane than the plane of said ramp surface whereby said tab formation is flexibly stressed downwardly somewhat from its normal elastic memory position to lie flat against said ramp surface when the bead formations are seated fully in said anchoring cavities.

18. An expansion joint seal assembly as defined in claim 17, wherein said intermediate diaphragm web portion includes connecting portions extending the length thereof between said fold portions and said anchoring bead formations extending from the apex of the juncture of said bottom and front wall portions of the bead formations along upwardly convex arching membrane portions of substantially the same thickness as said fold portions and said wall portions of the bead formations merging into upwardly diverging portions of the web portion extending from downwardly convex fold portions, said upwardly arching connecting portions extending in upwardly convergent relation to said rib-like tab formation.

19. An expansion joint seal assembly as defined in claim 17, wherein said intermediate diaphragm web portion comprises a plurality of sinuous reverse curved fold formations curved about parallel horizontal axes of curvature defining an accordion fold diaphragm web portion.

20. An expansion joint seal assembly as defined in claim 19, wherein said intermediate diaphragm web portion includes connecting portions extending the length thereof between said fold portions and said anchoring bead formations extending from the juncture of said bottom and front wall portions of the bead formations along upwardly convex arching membrane portions of substantially the same thickness as said fold portions and said wall portions of the bead formations merging into upwardly diverging portions of the web portion extending from downwardly convex fold portions, said upwardly arching connecting portions extending in upwardly convergent relation to said rib-like tab formation.

21. An expansion joint seal assembly as defined in claim 10, wherein said channel member includes a generally triangular cross-sectioned nose formation with rounded corners forming the upper boundary surface of said constricted entrance throat portion providing a flat ramp-like surface declining along a ramp plane disposed nearly perpendicular to said inclined plane providing a ramp against which the uppermost of said convex salient promontories moves as the anchoring bead formation is fulcrumed about said rounded toe formation.

22. An expansion joint seal assembly as defined in claim 21, wherein said intermediate diaphragm web portion includes connecting portions extending the length thereof between said fold portions and said anchoring bead formations extending from the juncture of said bottom and front wall portions of the bead formations along upwardly convex arching membrane portions of substantially the same thickness as said fold portions and said wall portions of the bead formations merging into upwardly diverging portions of the web portion extending from downwardly convex fold portions, said upwardly arching connecting portions extending in upwardly convergent relation to said rib-like tab formation.

* * * * *